United States Patent [19]

Janouschek

[11] 4,308,813

[45] Jan. 5, 1982

[54] DEVICE FOR FORMING A HEM ON FABRIC EDGES WITH THE USE OF A SEWING MACHINE

[75] Inventor: Heinz Janouschek, Steckborn, Switzerland

[73] Assignee: Fritz Gegauf Aktiengesellschaft Bernina-Nahmaschinenfabrik, Steckborn, Switzerland

[21] Appl. No.: 85,987

[22] Filed: Oct. 18, 1979

[30] Foreign Application Priority Data

Nov. 1, 1978 [CH] Switzerland ..... 11242/78

[51] Int. Cl.[3] ..... D05B 35/04

[52] U.S. Cl. ..... 112/143; 112/153

[58] Field of Search ..... 112/143, 141, 142, 153, 112/147, 136

[56] References Cited

U.S. PATENT DOCUMENTS

| | | | |
|---|---|---|---|
| 1,471,719 | 10/1923 | Beadle | 112/143 |
| 2,846,964 | 8/1958 | Clymer | 112/141 X |
| 2,880,685 | 4/1959 | Gardner | 112/141 |
| 3,974,788 | 8/1976 | Pignatti et al. | 112/141 X |

FOREIGN PATENT DOCUMENTS

| | | | |
|---|---|---|---|
| 1097243 | 1/1961 | Fed. Rep. of Germany | 112/143 |

*Primary Examiner*—H. Hampton Hunter

*Attorney, Agent, or Firm*—Birch, Stewart, Kolasch & Birch

[57] ABSTRACT

A hem forming means comprising a guide shoe suspended with limited movability on a spring clip directly in front of the needle hole of the machine. The spring clip, which is arranged at right angles to the conveying direction of the sewing material is attached to a ruler forming an edge abutment surface for the sewing material. In the zone of the edge abutment surface, the guide shoe is provided with a turndown nose which has, on the side facing away from the ruler, a lateral surface extending with broadening of the turndown nose at an acute angle with respect to the needle hole. This lateral surface extends at a spacing parallel to a beveled surface of the base plate, said beveled surface extending toward the needle center. The beveled surface constitutes one limitation of a wedge-shaped edge cutout of the base plate, into which the turndown nose of the guide shoe disposed thereabove can enter under spring pressure. The point of engagement of the spring clip at the guide shoe is, as seen from the ruler, outside of the wide center of the guide shoe, so that the contact pressure of the guide shoe sole is higher on the outside than in the zone of the contact surface of the ruler. In this way a flawless, straight guidance of the edge of the sewing material is obtained, making it possible to maintain an always constant small hem width, even in case of very fine sewing material.

7 Claims, 6 Drawing Figures

DEVICE FOR FORMING A HEM ON FABRIC EDGES WITH THE USE OF A SEWING MACHINE

BACKGROUND AND SUMMARY OF THE INVENTION

The present invention relates to a device utilized on a sewing machine for forming a hem on fabric edges.

Attachments of this type for sewing machines are well known in the art; see, for example, DAS [German Published Application] No. 1,097,243. These attachments usually comprise a laterally adjustable ruler guiding the edge of the fabric and means for hem formation arranged in the feeding direction in front of the sewing site, for example, on a base plate. When using such devices, problems are encountered if it is desired to produce especially fine hems on thin, finely woven sewing material. In this connection, it is especially difficult to ensure the straight guidance of the fabric edge to be provided with the hem. In the known devices, the sewing material must be guided by hand through, for example, parallel-walled or conical guide worms around which the passing sewing material is continuously turned, thus forming the hem which is subsequently fixed by means of a sewed seam. In this connection care must be taken that the desired hem width is accurately maintained. This requires great skill, especially in case of fine sewing material.

The present solution makes it possible to flawlessly solve this problem. The device of the present invention is characterized in that a guide shoe is associated with an edge contact surface of a ruler arranged vertically above the base plate. The guide shoe, which acts on the sewing material with a spring force, comprises, in the zone of the edge contact surface, a turndown nose portion arranged in parallel to the contact surface. The turndown nose, in cooperation with a beveled surface of the base plate, extending at an acute angle to the edge contact surface of the ruler, accomplishes the hem formation.

The guide shoe pressing with its underside on the sewing material is suitably suspended to be movable in all directions on a spring arm, the point of engagement of the spring arm with the guide shoe being disposed at a spacing from the ruler in such a way that the pressure surface portions of the guide shoe located on the side of the spring engagement point farther removed from the edge contact surface of the ruler exerts a higher amount of pressure than the pressure surface portion adjacent the ruler. Thus, the escape of the edge of the sewing material from the edge contact surface of the ruler is counteracted so that a flawless, straight guidance of the edge of the sewing material along the ruler is obtained. The turndown nose portion of the guide shoe exhibits a suitable lateral surface, on the side facing away from the ruler, which is parallel to the beveled surface of the base plate, wherein the aforementioned beveled surface constitutes one boundary surface of the edge cutout of the base plate, corresponding to the thickness of the base plate.

The attachment is mounted to the sewing machine so that its base plate covers a portion of the fabric transport lying in front of the needle hole of the machine. If, after the introduction of the sewing material between the base plate and the guide shoe up into the needle hole zone (with the edge of the sewing material being in contact with the contact surface of the ruler) the sewing machine is set into operation, then the transport mechanism pulls the sewing material through the device, wherein, on the one hand, the guide shoe effects a linear contact of the edge of the sewing material against the ruler, whereas the turndown nose of the guide shoe continuously presses the edge of the sewing material downwardly via the beveled surface of the base plate. The edge of the sewing material, thus beveled in this fashion, is turned in under the tension action of the transport mechanism upon leaving the device, and the thus-produced hem is continuously fixed at the sewing site which immediately follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
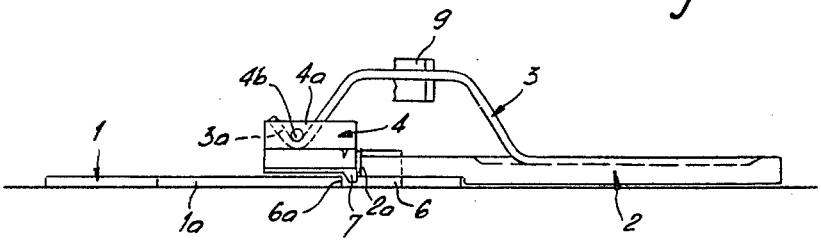
FIG. 1 shows an elevational view of the device seen in opposition to the transport direction.
Figure 2:
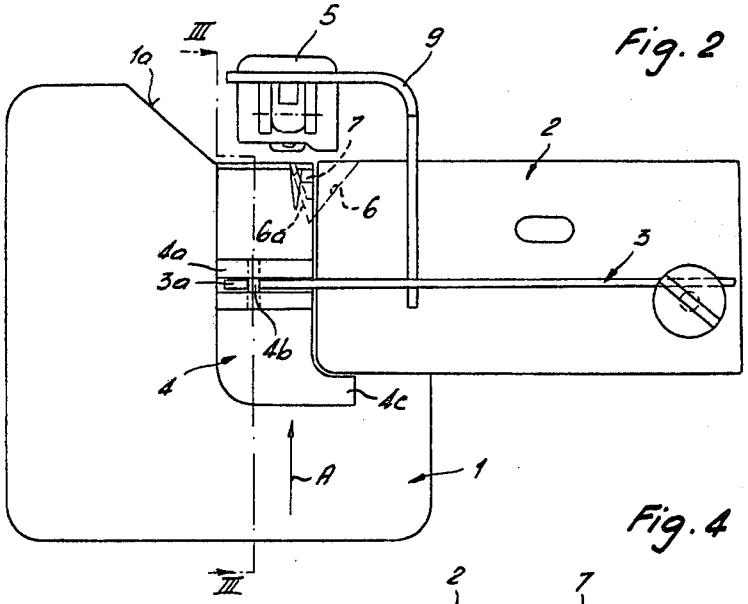
FIG. 2 is a top view of FIG. 1.
Figure 4:
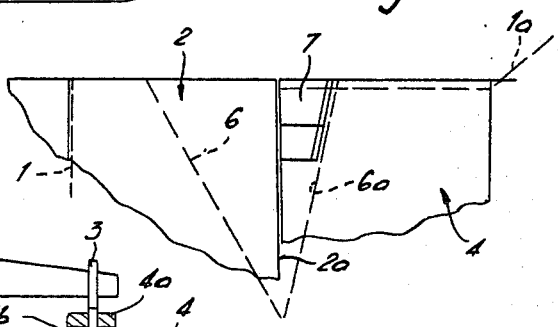
FIG. 4 shows, on an enlarged scale, a plan view of the hem forming section of the device seen from below.
Figure 3:
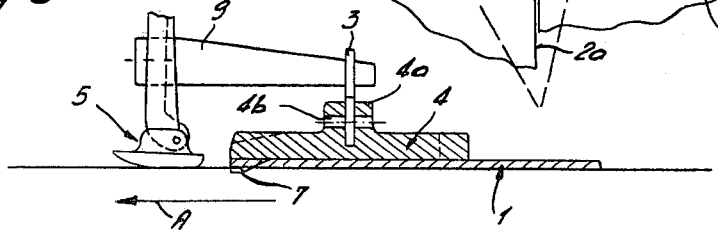
FIG. 3 is a section along line III—III of FIG. 2.

The device of the present invention comprises a base plate 1 lying on the foundation plate of the sewing machine. The side edge 1*a* of the base plate 1, which is set back by beveling, lies at right angles to the transporting direction A of the sewing material directly in front of the needle hole. The base plate 1 covers the corresponding part of the transport mechanism of the sewing machine. A ruler 2 is attached on the base plate 1 flush with the edge 1*a* of the base plate 1. The end face 2*a* of the ruler, which is disposed in parallel to the transporting direction A, serves as an edge contact surface at right angles to the base plate 1 for the sewing material. Transverse to the transporting direction A, one end of a wire spring clip 3 is affixed to the ruler 2. A guide shoe 4 is suspended at the free end portion 3*a* of the spring clip, said free end portion being angled in the shape of a V which extends beyond the ruler. The end portion 3*a* of the clip is supported with the aid of a cross pin 4*b* between two jaws 4*a* of the guide shoe, approximately in the longitudinal line of symmetry thereof, so that the guide shoe is pivotable within limits in a vertical plan and disposed at right angles to the edge contact surface 2*a* of the ruler 2. However, the guide shoe also remains somewhat movable in a vertical plane in parallel to the transporting direction A. A projection 4*c* of the guide shoe 4, which extends slightly behind the ruler 2, prevents the guide shoe, which is suspended at the spring clip 3, from being moved by means of the sewing material passing through the device in the direction of arrow A, between the base plate 1 and the guide shoe 4, against the sewing foot 5 of the sewing machine located directly in front of the guide shoe 4. As can be seen from the drawing, the point of engagement of the spring clip 3 with the guide shoe 4 is not provided in the center of the width of the guide shoe, but rather somewhat further removed from the side of the guide shoe facing the edge contact surface 2*a* of the ruler. Under practical conditions, this point of engagement of the spring clip 3 is disposed at a point approximately two-thirds of the width of the guide shoe. As a consequence, the contact force exerted by the spring clip 3 on the guide shoe and/or the guide shoe sole is somewhat smaller in the sole portion located more closely to the ruler 2 than in the portion more remote from the ruler. As can be seen from FIGS. 1, 2 and 4, the base plate 1 has, in the zone of the edge 1*a*, a wedge-shaped cutout 6 extending partially underneath the ruler 2 and partially underneath the guide shoe 4. Into the acute-angled portion of the cutout 6 located underneath the guide shoe 4 extends a turndown nose 7 provided on the side of the guide shoe sole facing the ruler 2 and terminating flush with the end face of the guide shoe facing the sewing foot 5. While the lateral surface of the turndown nose 7 facing the ruler 2 extends in parallel to the edge contact surface 2*a*, the lateral surface of the nose 7 facing away from the ruler is inclined approximately at the same angle, with respect to the transporting direction A, as the adjacent boundary edge of the cutout 6, and is furthermore slightly beveled in the downward direction, so that the turndown nose slightly tapers from the end face of the guide shoe toward the rear as well as at right angles thereto. Furthermore, the bottom surface of the nose 7 is slightly beveled in the zone of the end edge of the guide shoe 4 in parallel with the guide shoe sole and in the rearward direction.

Figure 5:
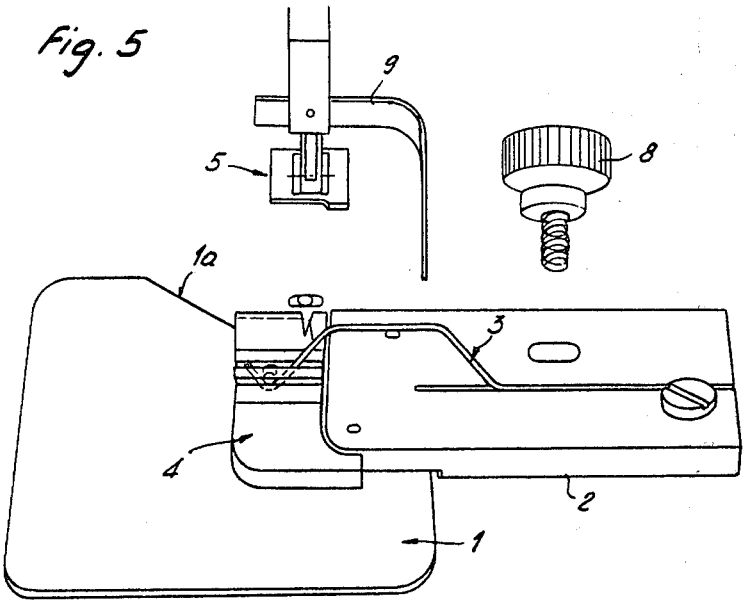
FIG. 5 shows the device in a diagrammatic, perspective view.

The unit, composed of the base plate 1, the ruler 2, the spring clip 3 and the guide shoe 4 can be detachably mounted to the foundation plate of the sewing machine by means of a knurled-head screw 8 (FIG. 5). To make it possible for the guide shoe 4 to be lifted against the effect of the spring clip 3 from the base plate 1 in order to introduce the sewing material, an angle bracket 9 is provided which is detachably mounted to the reciprocating shaft of the sewing foot 5. The arm of the angle bracket, extending in the forward direction past the ruler 2 and being slightly beveled on its topside, extends underneath the spring clip 3.

Figure 6:
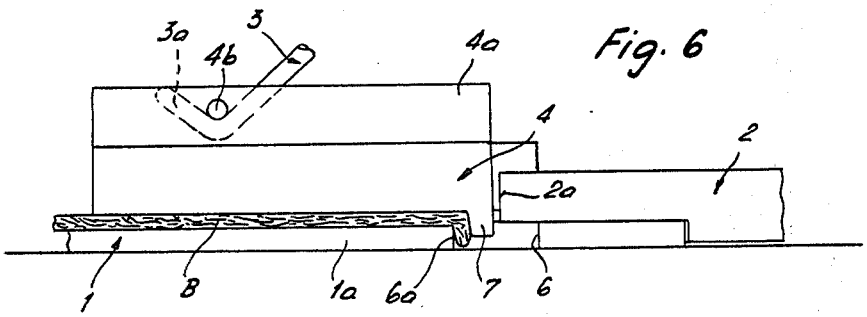
FIG. 6 shows, on an enlarged scale and in an elevational view analogously to FIG. 1, the hem forming section of the device in its operating condition.

The mode of operation of the device is as follows: To introduce the sewing material into the device, the material is pushed, with the edge to be hemmed lying against the contact surface 2*a*, in the direction of the arrow A beneath the guide shoe 4, said guide shoe being lifted off the base plate 1 by means of the raised sewing foot 5 with the aid of the angle bracket 9. During the subsequent lowering of the sewing foot 5, the angle bracket 9 releases the spring clip 3, so that the spring clip urges the guide shoe 4 against the sewing material (B in FIG. 6) with a somewhat higher pressure outside of the spring engagement point than in the zone of the ruler 2. If the sewing machine is then set into operation, and the sewing material B is pushed past the guide shoe 4 into the zone of the transport mechanism, then the latter can take over the further transportation of sewing material. The unequal contact pressure of the guide shoe 4 has the effect that the sewing material cannot escape from the contact surface 2*a* of the ruler. The nose 7, pressing on the edge of the sewing material moving along the contact surface 2*a*, turns this edge continuously downward around the edge 6*a* of the cutout, oriented at a spacing from the nose obliquely toward the center of the needle (FIGS. 4, 6) and pertaining to the base plate 1. The edge of the sewing material, which is, at all times, of the same width thanks to the straight edge guidance and is turned down at about 90°, is further rolled in and/or folded back onto the sewing material due to the pull of the transporting mechanism directly upon leaving the device, and is fixed in this position by the subsequent sewing step. After the seam is finished, the sewing foot 5 is lifted in the usual manner, whereby the angle arm 9 correspondingly lifts the spring clip 3 and thus the guide shoe 4 releases the sewing material.

It has been found to be particularly advantageous that the exact, straight guidance of the edge of the sewing material, even in the case of an extremely fine sewing fabric, e.g., tulle, etc., makes it possible to use turndown noses having a very small width which, in turn, results in especially fine hems.

It is understood that, in place of the repeatedly angled spring clip 3, it is also possible to provide another spring member enabling the guide shoe to exhibit limited movability in the transverse as well as longitudinal directions. However, the important feature is that the spring member engages the guide shoe eccentrically with respect to the guide shoe width to attain the aforedescribed, nonuniform pressure action and thus a straight travel of the sewing material. A material of a low friction coefficient, e.g., a glass-clear synthetic resin, is advantageously utilized for the guide shoe, to make it possible for the sewing material to pass through smoothly without undue distortion effects.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for forming hems on fabric edges on a sewing machine, with a ruler guiding the edge of the sewing material and with means arranged on a base plate for forming the hem, characterized in that a guide shoe is associated with an edge contact surface of the ruler located vertically above the base plate, said guide shoe acting on the sewing material under spring pressure and exhibiting in the zone of the edge contact surface a turndown nose portion disposed in parallel to this surface, said nose portion, in cooperation with a beveled surface of the base plate located at an acute angle to the edge contact surface of the ruler, effecting the hem formation.

2. A device according to claim 1, characterized in that the guide shoe is suspended with limited free movability on a spring, the point of engagement of this spring at the guide shoe being such that the pressure force exerted by the guide shoe sole is higher on the side of the point of engagement facing away from the ruler than in the zone of the ruler.

3. A device according to claim 2, characterized in that the guide shoe is suspended on the free end of a spring clip arranged at right angles to the transporting direction of the sewing material and being affixed with its other end to the ruler, said spring clip engaging the guide shoe approximately in the longitudinal line of symmetry of the guide shoe but in the transverse direction as seen from the ruler outside of the wide center of the guide shoe.

4. A device according to claim 3, characterized in that the turndown nose portion provided on the guide shoe sole has a lateral surface on the side of the ruler which is flush with the side of the guide shoe and extends in parallel to the edge contact surface of the ruler, while the opposite lateral surface of the turndown nose extends at an acute angle with respect to the needle center and at a spacing in parallel to the beveled surface of the base plate, said beveled surface being formed on one boundary edge of a wedge-shaped edge cutout of the base plate.

5. A device according to one of claims 1 to 4, characterized in that the base plate covers the portion of the transporting mechanism lying in front of the needle hole of the sewing machine as seen in the transporting direction.

6. A device according to one of claims 1 to 4, characterized in that the guide shoe consists of a material having a low friction coefficient, suitably of a synthetic resin.

7. A device according to one of claims 1 to 4, characterized in that an entrainment means is detachably mounted to the sewing foot of the sewing machine and is reciprocatable with this sewing foot, said entrainment means being operatively connected with the guide shoe for the purpose of lifting the latter off the base plate.

* * * * *